United States Patent [19]

Kiefer et al.

[11] Patent Number: 4,860,962

[45] Date of Patent: Aug. 29, 1989

[54] BOWL-MILL CRUSHER

[75] Inventors: Dieter Kiefer, Wesel Bislich; Helmut Grommes, Duisburg, both of Fed. Rep. of Germany

[73] Assignee: Deutsche Babcock Werke Aktiengesellschaft, Oberhausen, Fed. Rep. of Germany

[21] Appl. No.: 281,093

[22] Filed: Dec. 7, 1988

[30] Foreign Application Priority Data

Dec. 9, 1987 [DE] Fed. Rep. of Germany ..... 3741611

[51] Int. Cl.[4] ..... B02C 15/00

[52] U.S. Cl. ..... 241/117; 241/100

[58] Field of Search ..... 241/117–121, 241/100

[56] References Cited

U.S. PATENT DOCUMENTS

| | | | |
|---|---|---|---|
| 799,244 | 9/1905 | Lehmann | 241/119 |
| 888,581 | 5/1908 | Brown | 241/121 X |
| 2,641,387 | 6/1953 | Christensen | 241/119 X |
| 4,600,157 | 7/1986 | Willach et al. | 241/119 X |

*Primary Examiner*—Timothy V. Eley

*Attorney, Agent, or Firm*—Max Fogiel

[57] ABSTRACT

An owl-mill crusher with stationary grinding rollers (6) inside a housing (1) that roll over a grinding bowl (3) resting on a rotating grinding-bowl support (5). An air box (8) is provided below the grinding bowl (3). A circular-conical disk (17) is secured to the grinding-bowl support (5) with its outer edge pointing down. A stationary cleanout arm (24) is positioned above the disk (17) with one end extending into the extraction shaft (20) of the removal container (21), which is mounted on the side of the housing. Several blades (25) are secured to the bottom of the disk.

4 Claims, 3 Drawing Sheets

BOWL-MILL CRUSHER

BACKGROUND OF THE INVENTION

The cleanout mechanism in a known bowl-mill crusher (Au-fbereitungs-Technik 12 [1971], 9, 542-43) consists of two arms secured to the grinding-bowl support that sweep over the horizontal bottom of the air box at each revolution. Coarse material that arrives in the air box from the grinding area by way of the nozzle ring is emptied into the removal container through an extraction opening in the bottom of the air box. To protect the cleanout arms from damage or destruction by coarse particles, the arms are loosely articulated to the grinding-bowl support and can roll over the particles. An articulation of this type is subject to malfunction. Furthermore, larger quantities of ground material arrive in the air box from the grinding area when the supply of air to the grinder is suddenly discontinued in the event of an emergency turnoff. The known cleanout arms, which sweep the horizontal bottom of the air box, are then no longer able to remove the ground material out of the air box rapidly enough.

SUMMARY OF THE INVENTION

The object of the invention is to improve the cleanout mechanism of the generic bowl-mill crusher to the extent that it will be less subject to malfunction and that the material will be removed from the air box more rapidly.

According to the present invention circular-conical disk diverts the material that arrives in the air box from the grinding area through the nozzle ring outward by centrifugal force, whence it is conveyed farther on into the extraction shaft outside of the bowl housing and into the removal container by way of the cleanout arms. This system ensures rapid cleanout of the air box. Eliminating the free articulation of the arms makes it less subject to malfunction. The bottom of the bowl is simultaneously protected by the disk against the impact of hot air and is accordingly less thermally stressed because the space between the disk and the bottom is subjected to barrier air.

BRIEF DESCRIPTION OF THE DRAWINGS

One embodiment of the invention will now be specified with reference to the drawing, wherein.

DESCRIPTION OF THE PREFERRED EMBODIMENT

Figure 1:
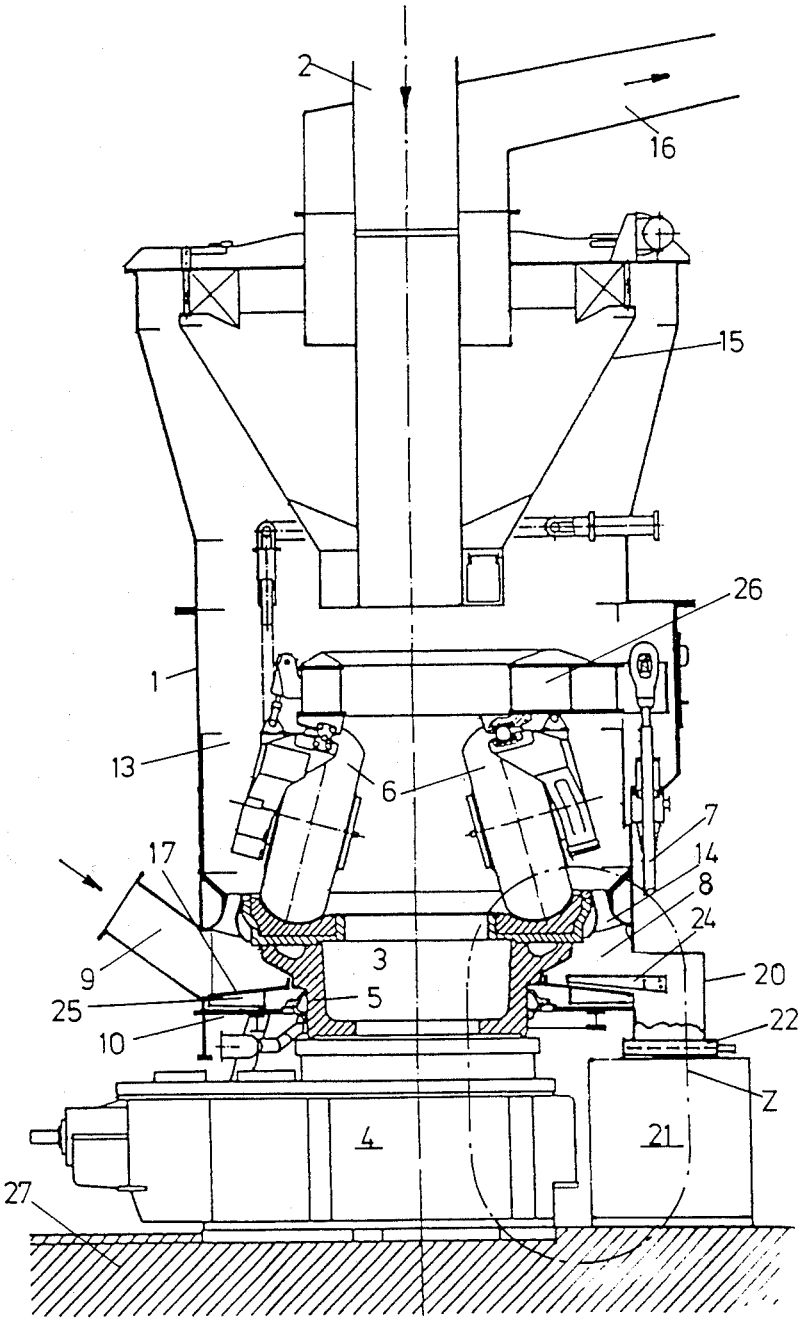
FIG. 1 is a longitudinal section through a bowl-mill crusher.
Figure 2:
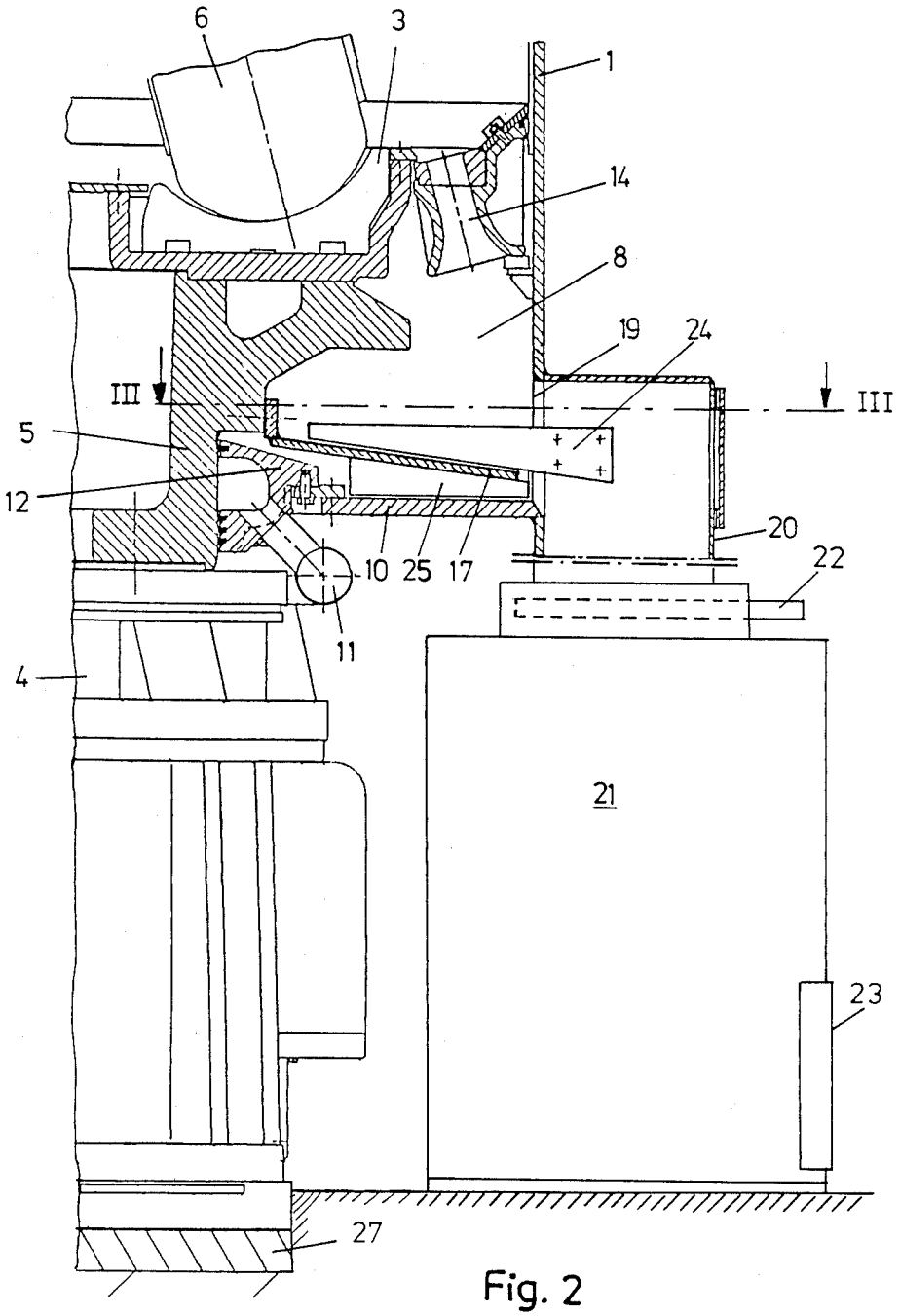
FIG. 2 illustrates the detail Z in FIG. 1.
Figure 3:
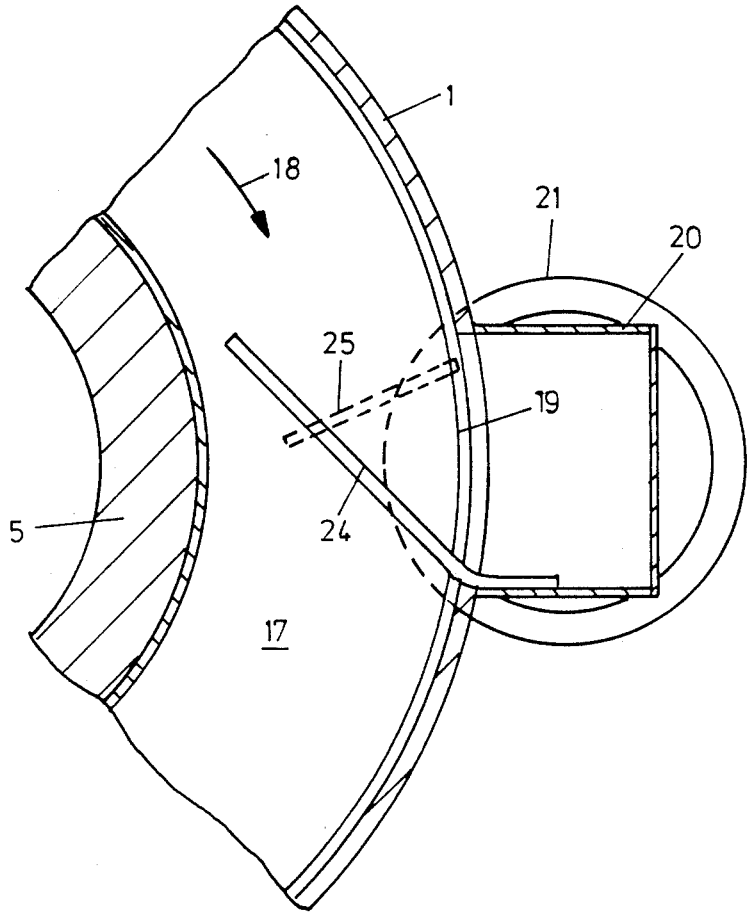
FIG. 3 is a section along the line III—III in FIG. 2.

The bowl-mill crusher has a housing 1, through which extends a riser 2 that supplies crude coal. Inside housing 1 is a rotating horizontal grinding bowl 3 that is driven by an unillustrated motor by way of a transmission 4. Grinding bowl 3, which is composed of several segments although it can also be in one piece, is connected to transmission 4 by way of a grinding-bowl support 5. Rigidly mounted grinding rollers 6 roll over grinding bowl 3. Grinding rollers 6 are supported on a frame 26 that is resiliently tensioned against the base 27 of the crusher by way of rods 7. This tensioning mechanism resiliently forces grinding rollers 6 against grinding bowl 3.

At the bottom of housing 1 and below grinding bowl 3 is an air box 8 that is provided with an air-supply connection 9. The bottom of air box 8 is closed off by a horizontal bottom 10 and communicates with a grinding area 13 inside housing 1 through a nozzle ring 14. Mounted on housing 1 is a separator 15, into which there extends a dust-exit line 16. A drying and conveying gas in the form of hot air is introduced into air box 8 through air-supply connection 9. The air flows through nozzle ring 14 and into grinding area 13, picks up the coal dust produced by grinding rollers 6 against grinding bowl 3, and conveys it out by way of separator 15 and dust-exit line 16.

Material that cannot be ground, foreign bodies for example, can enter air box 8 through nozzle ring 14 and must be removed therefrom. When the grinder must be shut down in the event of an emergency due to a sudden interruption in the supply of air, some of the coal dust in grinding area 13 will drop into air box 8. Since air box 8 is hot from the hot air, there is a risk of the coal dust igniting if it is not removed rapidly enough.

The cleanout mechanism that will now be specified will remove foreign bodies and, if necessary, coal dust. Secured to grinding-bowl support 5 and below grinding bowl 3 is a circular-conical disk 17, the outer edge of which points down and extends almost to the wall of housing 1. Circular-conical disk 17 rotates with grinding-bowl support 5 in the direction indicated by arrow 18. At the level of circular-conical disk 17, housing 1 is provided with an extraction opening 19, the lower surface of which merges into the bottom 10 of air box 8. Extending out of extraction opening 19 is an extraction shaft 20 that rests on a preferably cylindrical removal container 21. Removal container 21 has a slide 22 at its entrance and an extraction opening 23, which can be closed off, at the bottom.

Above circular-conical disk 17 is a stationary cleanout arm 24, one end of which extends into extraction shaft 20 and is secured to the wall of extraction shaft 20. The inner end of stationary cleanout arm 24 points opposite the direction that circular-conical disk 17 rotates in. The lower edge of stationary cleanout arm 24 slopes along with circular-conical disk 17 and faces it at a variable distance.

Secured to the bottom of disk 17 are several blades 25. The outer edge of blades 25 extends beyond the outer margin of disk 17. The inner end of blades 25 precedes the outer end along the direction that disk 17 rotates in. During one rotation of disk 17, blades 25 generate an outward flow of air that cools the bottom 10 of air box 8.

The material that arrives in air box 8 from grinding area 13 through nozzle ring 14 slides down and out due to the sloping surface and to the centrifugal force and is scraped off disk 17 and diverted into extraction shaft 20 by cleanout arm 24. The portion of material that arrives on the bottom 10 of air box 8 by way of the margin of disk I7 is picked up by blades 25 and also conveyed into extraction shaft 20.

The rotating grinding-bowl support 5 is sealed off from the stationary air box 8 by a barrier-air housing !2 provided with a barrier-air connection 11. Barrier-air housing 12 is secured to the bottom 10 of air box 8 and surrounds grinding-bowl support 5, creating a barrier-air chamber. The barrier air that is supplied to the barrier-air chamber through barrier-air connection 11 enters air box 8 below disk 17 and is forced outward by the air box. This intentional outflow of barrier air supports the flow of air generated by blades 25 to cool bottom 10.

We claim:

1. A bowl-mill crusher comprising: a housing having a top and a bottom; stationary grinding rollers inside said housing; a grinding bowl inside said housing, said grinding rollers rolling over said grinding bowl; a rotating grinding bowl support for supporting said grinding bowl; an air box at the bottom of said housing and beneath said grinding bowl; an extraction shaft extending laterally from said air box; a removal container coupled to said extraction shaft; cleanout means coupled to said grinding bowl support and comprising: a circular-conical disk secured to said grinding bowl support and having an outer edge pointing downwardly, and a stationary cleanout arm positioned above said disk and having an end extending into said extraction shaft coupled to said removal container.

2. A bowl-mill crusher as defined in claim 1, including a plurality of blades secured to the bottom of said circular-conical disk and having inner ends preceding outer ends of said blades along a direction of rotation of said grinding bowl and said grinding bowl support.

3. A bowl-mill crusher as defined in claim 1, including a barrier-air housing surrounding said grinding-bowl support; and exit means from said barrier-air housing in said air box and below said circular-conical disk.

4. A bowl-mill crusher as defined in claim 3, wherein said air box has a bottom, barrier air flowing out of said barrier-air housing and combining with a stream of air genrated by said blades to produce a stream cooling the bottom of said air box.

* * * * *